United States Patent [19]

Bartenstein

[11] 3,943,740

[45] Mar. 16, 1976

[54] TOOL PACK FOR FORMING METALLIC CONTAINERS

[75] Inventor: Michael F. Bartenstein, Proctor, Vt.

[73] Assignee: Vermont Marble Company, Proctor, Vt.

[22] Filed: Apr. 1, 1075

[21] Appl. No.: 564,147

[52] U.S. Cl. ..... 72/45; 72/345; 72/349; 72/468

[51] Int. Cl.[2] ..... B21D 37/14; B21D 45/00

[58] Field of Search ..... 72/344, 345, 347, 349, 72/467, 468, 45

[56] References Cited

UNITED STATES PATENTS

| | | | |
|---|---|---|---|
| 166,568 | 8/1875 | Thomas | 72/468 |
| 1,742,795 | 1/1930 | Tanner | 72/349 |
| 1,977,327 | 10/1934 | Smith | 72/349 |
| 3,399,558 | 9/1968 | Smith et al. | 72/468 |
| 3,440,862 | 4/1969 | Phillips | 72/467 |
| 3,744,293 | 7/1973 | Miller | 72/467 |

*Primary Examiner*—Lowell A. Larson
*Attorney, Agent, or Firm*—Bacon & Thomas

[57] ABSTRACT

The tool pack is designed for mounting on a metal drawing machine or press, and includes a frame having a mounting slot for holding a cartridge that carrys a drawing die, the mounting slot having a right angle corner formed therein against which the cartridge is seated and removably secured by hydraulic clamping apparatus, whereby precise positioning of the cartridge is assured. The cartridge includes screw actuated fluid adjusters for precisely positioning the die in two directions, to secure accurate alignment. Mounted rearwardly of the cartridge is a stripper assembly including radially movable, pivoted jaws that are hydraulically extended and retracted to provide stripping action.

12 Claims, 8 Drawing Figures

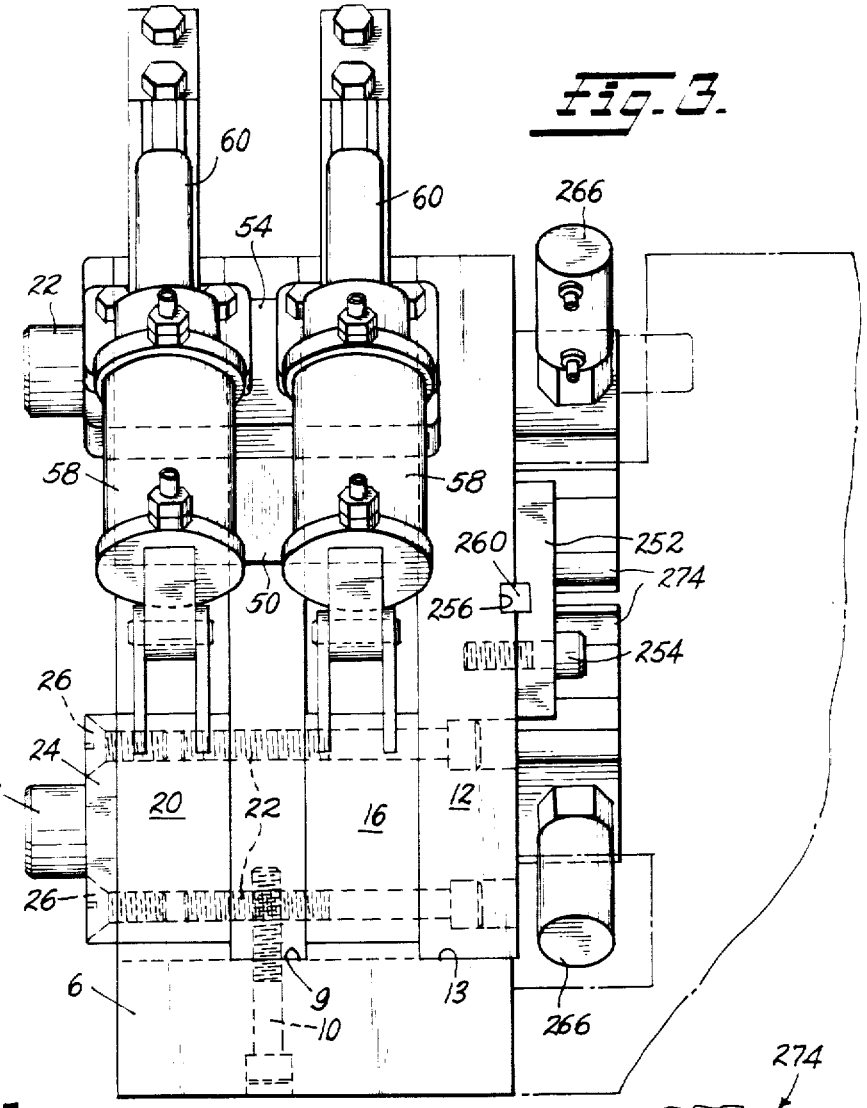
Fig. 3.
Fig. 5.
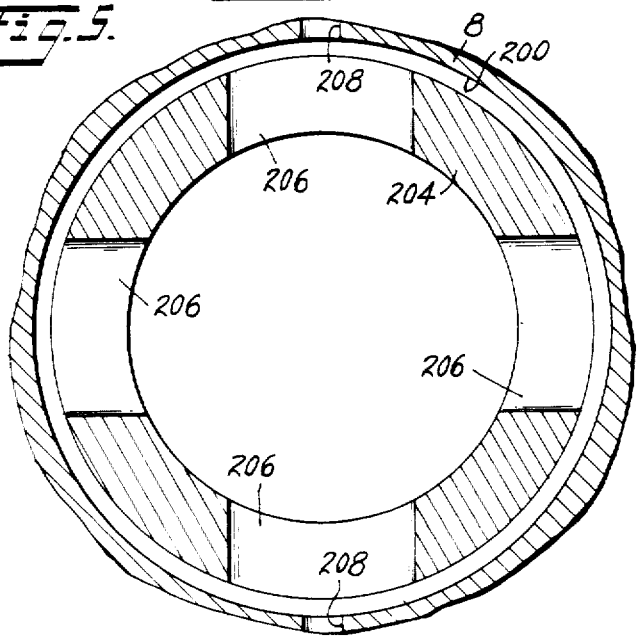
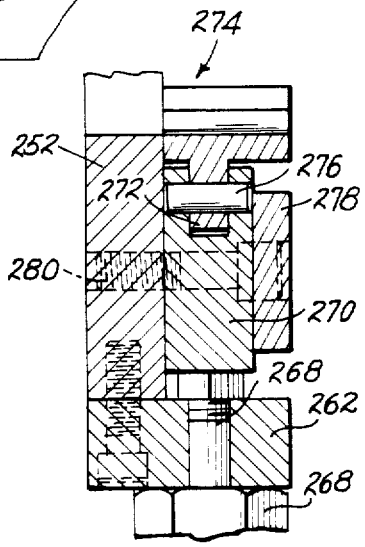
Fig. 6.

8
140
144
72
42
8
210
154
172
38
2
7
70
114
118
208
174
150
266
82
112
176
120
78
152
262
96
116
174
156
5
160
278
124
158
94
76
168
162
164
44
206
166
40
258
274
100
204
212
260
258
274
24
202
206
252
260
106
200
168
278
104
5
170
108
262
208
90
80
12
266
210
8
9
13
250
7
23
6

TOOL PACK FOR FORMING METALLIC CONTAINERS

BACKGROUND OF THE INVENTION

1. Field of the Invention

The present invention relates generally to machines or presses for draw forming metal containers, and more particularly to a novel tool pack for such a machine, designed to provide for quick exchange of forming dies, to enable precise adjustments in alignment with a minimum of time and operator skill, and to assure stripping of the formed container from the forming ram.

2. Description of the Prior Art

The forming of metal containers and the like through a drawing process is well known, and many different drawing machines or presses have been designed over the years. At the heart of such drawing apparatus are the die or dies, and the ram used to propel the sheet material through the dies. For effective operation and prolonged operating life, it is essential that proper alignment of the dies and the ram be established and maintained. For this purpose different arrangements for mounting the dies have been offered.

It has been found that an effective procedure for mounting dies in drawing apparatus is to first mount the die itself in a cartridge or die holder, which in turn is then mounted in an operative position on the apparatus. The apparatus will usually include means for effecting proper alignment of the cartridge, and the cartridge will include means to adjust the die. A tool pack of this general type is shown in U.S. Pat. No. 3,735,629, and it is to this general concept that the present invention relates.

While cartridge-type tool packs are known, they frequently cannot be freely exchanged with near instantaneous alignment of the new cartridge. Further, the arrangement provided for finely adjusting the position of the die within the cartridge usually is either difficult to manipulate or incapable of universal precision adjustments, or both. There is thus need for a cartridge-type tool pack arrangement that is designed for quick interchange, and which can be easily adjusted for final alignment with great precision. The present invention is intended to satisfy that need.

SUMMARY OF THE INVENTION

The tool pack of the present invention is designed to be mounted on the frame of the drawing machine or press in alignment with the axis of movement of the press ram, and includes both the forming die assembly, and a stripper assembly to ensure removal of the formed container from the ram. The forming die assembly of the described preferred embodiment of the invention includes both a redraw die and an ironing die, but other die arrangements are possible utilizing the present concepts.

The dies are each carried in a cartridge or die holder, which is formed to present a rectangular configuration on the exterior thereof, the top, bottom and side walls of the cartridge being precision formed to extend at right angles to each other. The tool pack includes a mounting frame that is aligned on the press frame by the usual aligning keys and slots and secured by machine screws, and which defines a separate mounting slot for receiving each cartridge. Each mounting slot is bound by a bottom wall and an inner side wall projecting upwardly from the bottom wall at precisely 90°, the inner side wall and the bottom wall thus defining a right angle seat for receiving a right angle corner of the rectangular cartridge.

The cartridge is merely dropped into its mounting slot in the mounting frame. A hydraulically operated clamping arm then engages the upper outer corner of the cartridge through a pivoted V-block, and positively and precisely seats the opposite, inner lower corner of the cartridge in the seat defined in the mounting slot by the inner side wall and the bottom wall thereof. The hydraulic clamping arm maintains the cartridge firmly seated in position during operation of the forming machine or press.

When it is desired to change the die-carrying cartridge, the hydraulic cylinder is operated in a reverse manner to move the clamping arm and its V-block free from the cartridge. Thereafter, the cartridge is simply lifted clear of the mounting frame, and a new cartridge is inserted. The new cartridge is then again positively seated, merely by activating the hydraulic cylinder to move the clamping arm into clamping position.

In order to provide for precise final alignment of the die within its cartridge after the cartridge is secured in the mounting frame, the die itself is mounted within a rectangular location block received within a rectangular tray in the cartridge. Spring biased adjustment buttons are located on the bottom and inner side wall of the rectangular tray, and opposite each set of resilient adjustment buttons a hydraulic adjuster is mounted on the cartridge. The hydraulic adjusters are actuated by adjustment screws, and provide for positioning the location block carrying the die in both a vertical and horizontal direction; because of their hydraulic nature they can be minutely adjusted to provide precision alignment of the die with its associated ram.

In the preferred embodiment of the invention, the redraw die is mounted directly in front of the ironing die, the two dies being mounted by separate cartridges in an identical manner. Mounted on the side of the tool pack opposite the ironing die is a stripper assembly, comprising four arcuate jaws each pivoted to the inner end of a radially movable piston leading from a hydraulic cylinder. After the press ram pushes the blank through the redraw and the ironing dies, the stripper assembly hydraulic cylinders are automatically actuated to move the stripper jaws radially inwardly toward the ram. The ram is then withdrawn, and the jaws function to strip the formed container therefrom.

By pivotally mounting the stripper jaws, they are free to adjust to slight differences in the alignment of the ram and the forming dies relative thereto. When the ram has been withdrawn, the control circuitry of the forming machine operates in the usual manner to return the stripper jaws to their retracted positions, thereby terminating an operating cycle.

It is the principal object of the present invention to provide a tool pack for a draw forming machine, designed to allow for rapid changing of the forming dies and easy precision alignment thereof with the forming ram.

A further object is to provide a tool pack having a stripper assembly thereon that is designed to compensate for minor misalignments of the forming dies and ram relative thereto, and which is effective to remove the formed container from the ram.

Yet another object is to provide a cartridge for mounting a forming die, designed to provide minute adjustments of the position of the forming die to secure precision alignment thereof with a forming ram.

Still another object is to provide an arrangement for quickly mounting a die cartridge on a mounting frame, with positive and precision seating thereof.

Other objects and many of the attendant advantages of the present invention will become readily apparent from the following Description of the Preferred Embodiment, when taken in conjunction with the accompanying drawings.

BRIEF DESCRIPTION OF THE DRAWINGS

FIG. 3 is an enlarged side elevational view of the tool pack assembly as viewed from the right side of FIG. 2;

FIG. 5 is a fragmentary vertical sectional view taken on the line 5—5 of FIG. 4, showing the lubrication coolant ring and the grooves associated therewith;

FIG. 8 is an enlarged fragmentary vertical sectional view through one of the stripper jaws, taken on the line 8-8 of FIG. 7.

DESCRIPTION OF THE PREFERRED EMBODIMENT

Figure 1:
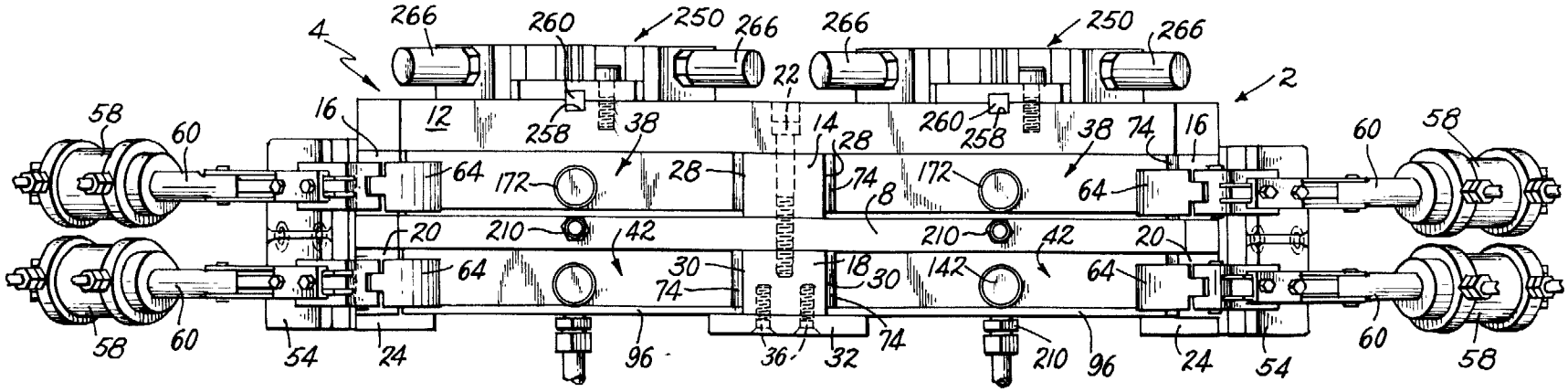
FIG. 1 is a plan view of a tool pack assembly according to the invention, incorporating two sets of cartridges for holding redraw and ironing dies, and designed to produce a drawn containerlike object.

Referring now to the drawings, the tool pack of the invention is indicated generally at 2, and is intended to be precisely mounted on the frame of a press (not shown) by the usual machine screws, keys and the like. The tool pack 2 includes a mounting frame 4, comprising a rectangular base 6 having a vertical separator block 8 seated in a slot 9 and secured thereto by machine screws 10. A rectangular end plate 12 seated in a slot 13 is disposed to the rear of the separator block 8, and is held in spaced relationship from the separator block by center spacer blocks 14 and end spacer blocks 16. Similar center and end spacer blocks 18 and 20 are disposed on the front face of the separator block 8, the end plate 12, the spacer blocks 14 and 16 on the rear face of the separator block 8, and the spacer blocks 18 and 20 on the front face of the separator block 8 all being secured together by machine screws 22. The end plate 12 is also secured to the base 6 by machine screws 23.

The end spacer blocks 16 and 20 all rest on the upper surface of the base 6, and extend upwardly for only about one-third the height of the separator block 8. The end spacer blocks 20 have rectangular cap plates 24 secured thereto by machine screws 26, the cap plates 24 extending inwardly beyond the inner edges of their associated spacer blocks 20 to form retaining edges.

Similarly, the center spacer blocks 14 and 18 have their lower ends disposed to rest on the base 6. The opposite vertical side surfaces 28 and 30 of the center spacer blocks 14 and 18, respectively, are machined to be flat and parallel, and are disposed at precisely a right angle to the flat upper surface of the base 6, whereby precise right angle corners are formed upon which to seat the lower, inner corners of the rectangular die holder cartridges to be described hereinafter. The front, center spacer block 18 has upper and lower cap plates 32 and 34 secured to the front face thereof by machine screws 36, the cap plates 32 and 34 extending inwardly from the vertical side surfaces 30 of the spacer block 18 to form retaining edges.

The mounting frame 4 thus is provided with four mounting slots of precision dimensions and configuration, each designed to receive a rectangular die holder cartridge from the open upper end thereof. In the invention the two rear mounting slots disposed on either side of the rear center spacer block 16, and defined between the separator block 8 and the end plate 12, are intended to receive die holder cartridges 38, each mounting an ironing die 40. Similarly, the front mounting slots disposed on either side of the front center spacer block 18, and defined between the front face of the separator block 8 and the inwardly extending faces of the cap plates 24, 32 and 34, are intended to receive die holder cartridges 42, each mounting a redraw die 44. The die holder cartridges 38 and 42 have precision formed rectangular configurations with the top, bottom and side walls at precise right angles to each other, such that the corners thereof will exactly seat into the precision formed lower, inner corners of their respective mounting slots.

In order to ensure positive seating of the rectangular die holder cartridges 38 and 42 within their mounting slots, and to secure them firmly in position during operation of the drawing press, a separately operable hydraulic hold-down mechanism is associated with each of the four mounting slots provided in the mounting frame 4. Referring again to the drawings, the separator block 8 has outwardly projecting upper corner portions 50 thereon, each terminating in a flat mounting face 52 disposed at a 45° angle to the horizontal. A laterally extending mounting bracket 54 is secured to each mounting face 52 by machine screws 56, and mounted on the opposite ends of each mounting bracket 54 is a double-acting hydraulic cylinder 58 incorporating a piston rod 60 that is connected to move a pivoted clamping arm 62 toward and away from the associated mounting slot in the mounting frame 4, in response to extension and retraction, respectively, of the piston rod 60.

Figure 2:
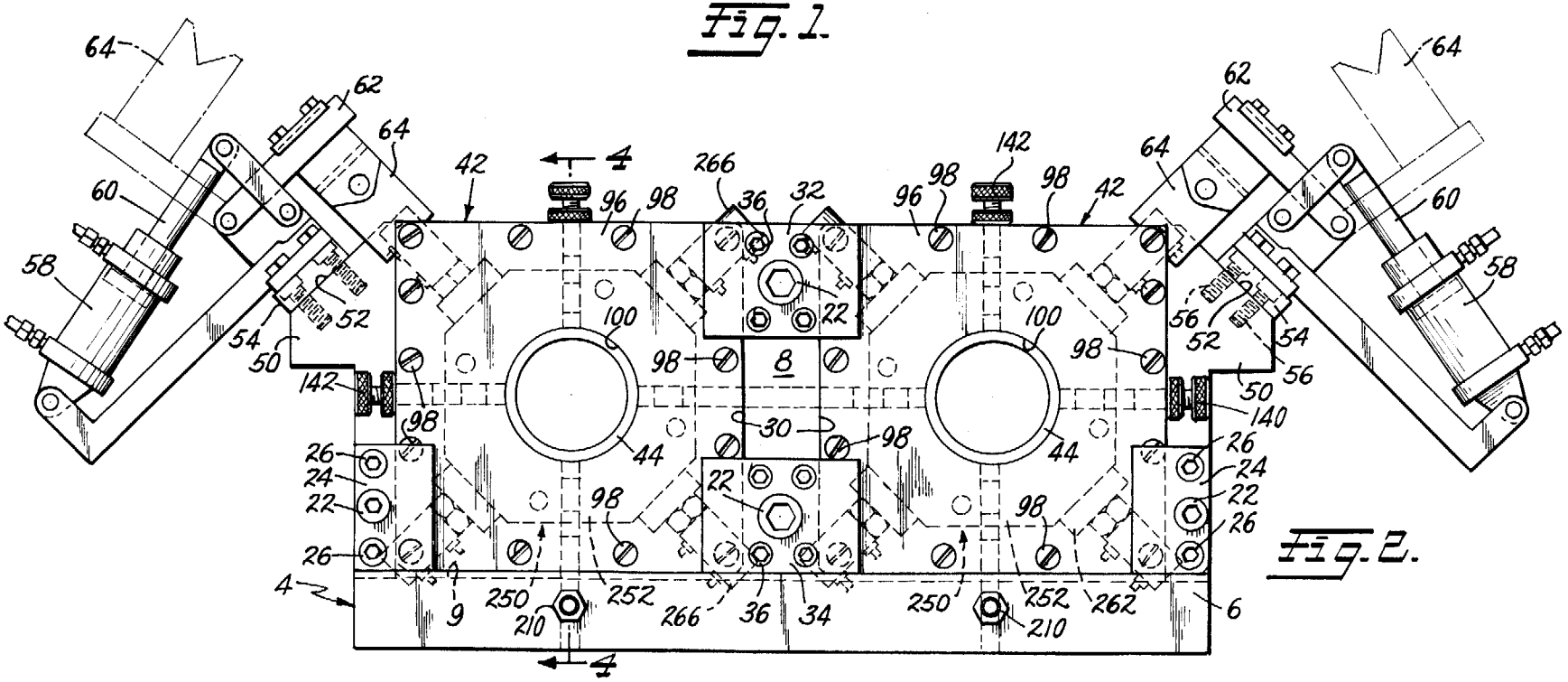
FIG. 2 is a front elevational view of the tool pack assembly of FIG. 1, showing in particular how the cartridge clamping arms operate.

Each clamping arm 62 carries a V-block 64 on the end thereof, which is engageable with the upper, outer corner of the associated rectangular die holder cartridge 38 or 42 when such has been placed in its mounting slot in the frame 4, and when the hydraulic cylinder 58 has been activated to extend the piston rod 60. The hydraulic cylinders 58 are thus effective, acting through the V-blocks 64, to positively seat their associated die holders cartridges 38 or 42, and to secure them firmly in position during use. When it is desired to replace a cartridge 38 or 42, the associated hydraulic cylinder 58 is activated to retract its piston rod 60, thereby clearing the attached V-block 64 from the cartridge, as shown in phantom lines in FIG. 2. The respective die holder cartridge 38 or 42 can then be easily lifted from its slot, and a new one inserted. Thereafter, the hydraulic cylinder 58 is activated in the opposite direction, to effect seating and securing of the new cartridge.

It is thus seen that an arrangement has been provided which assures precision seating of the die holder cartridges 38 and 42 in their respective mounting slots on the mounting frame 4, through the use of precision and mating right angle surfaces at the lower, inner corners of the slots, and on the corners of the cartridges 38 and 42. Further, it is readily seen that the hydraulic hold-down mechanism associated with each slot is effective to ensure positive seating of the die holder cartridge, to secure it in position during use, and to provide for easy and quick removal and replacement of the cartridge when needed. Because each hydraulic hold-down mechanism is separately operable, any one cartridge can be removed and replaced without any interference with the other cartridges.

Figure 4:
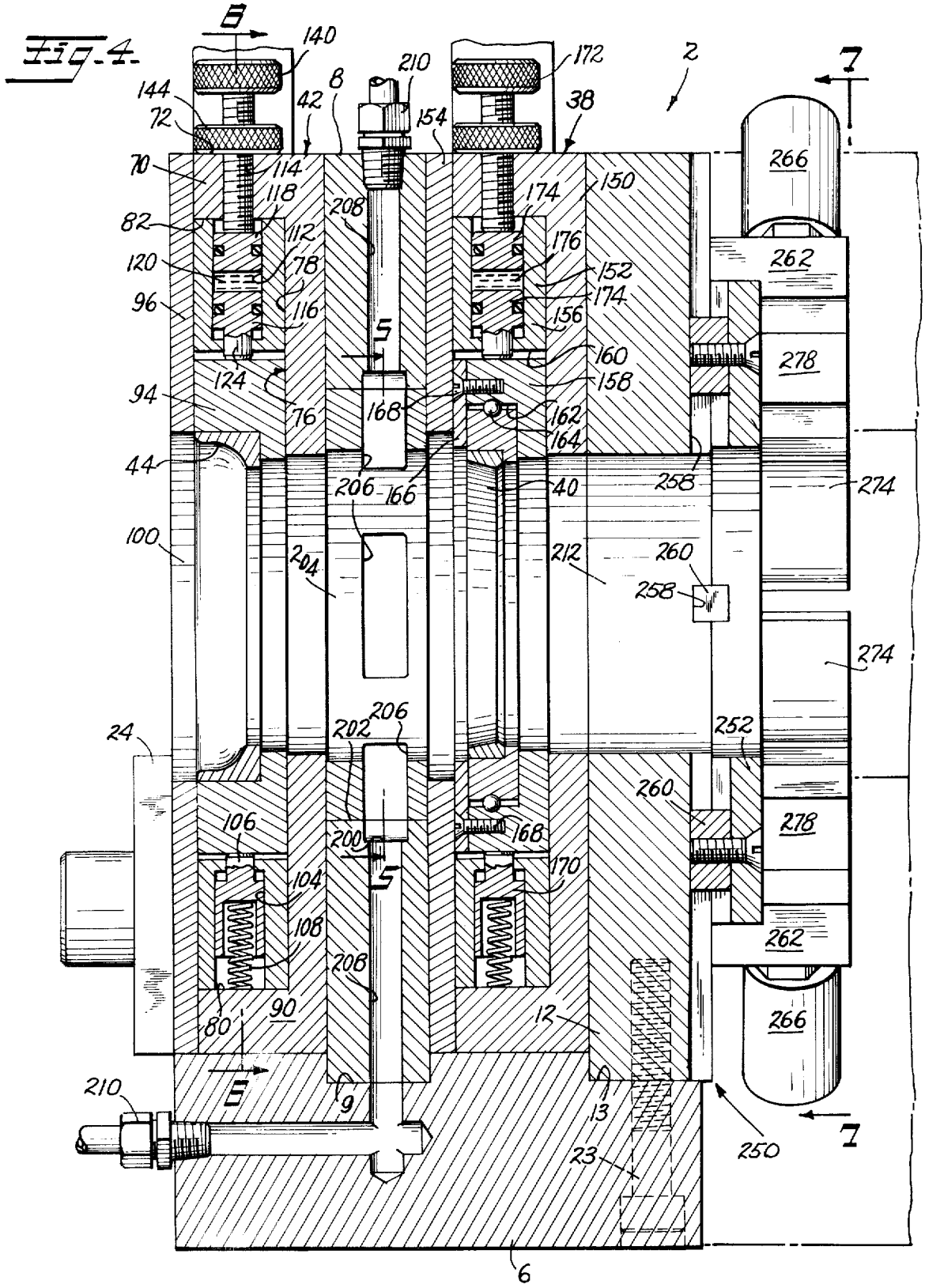
FIG. 4 is an enlarged fragmentary vertical sectional view, taken on the line 4—4 of FIG. 2, and showing details of the hydraulic adjusters for the die locating blocks and of the arrangement for forced lubrication of the container during the drawing process.
Figure 7:
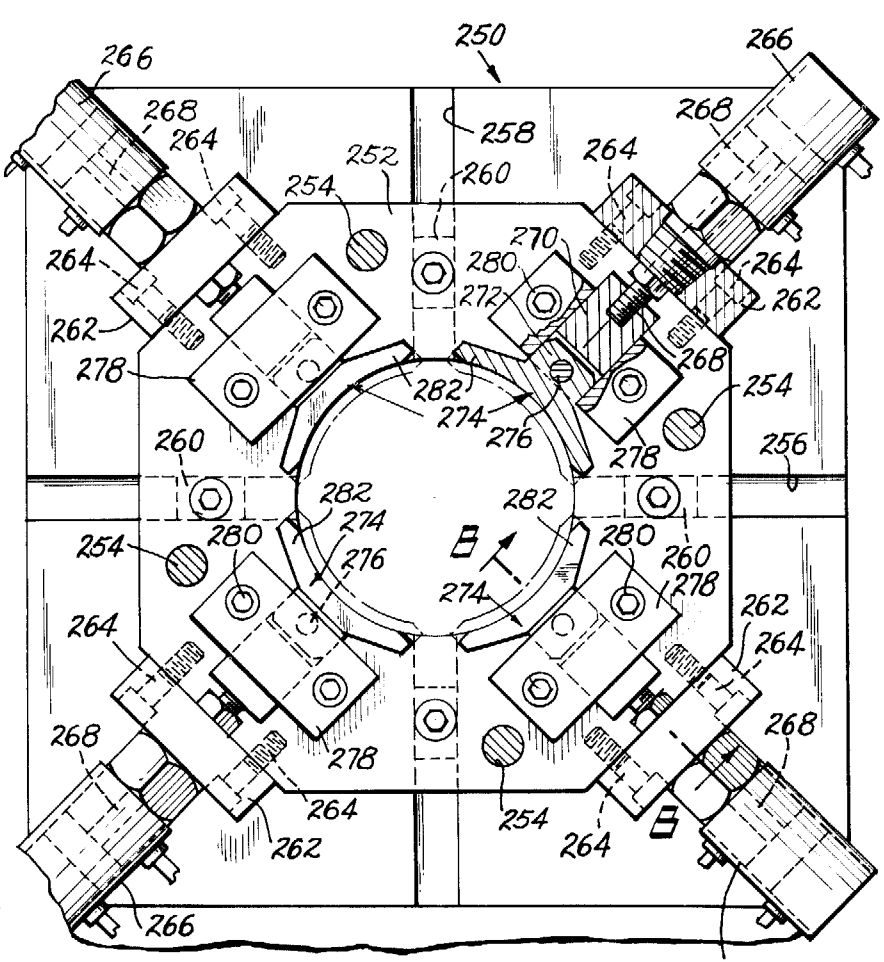
FIG. 7 is an end elevational view of the stripper side of the tool pack, partially broken away to show details of one of the stripper jaws and its mounting arrangement.
Figure 6:
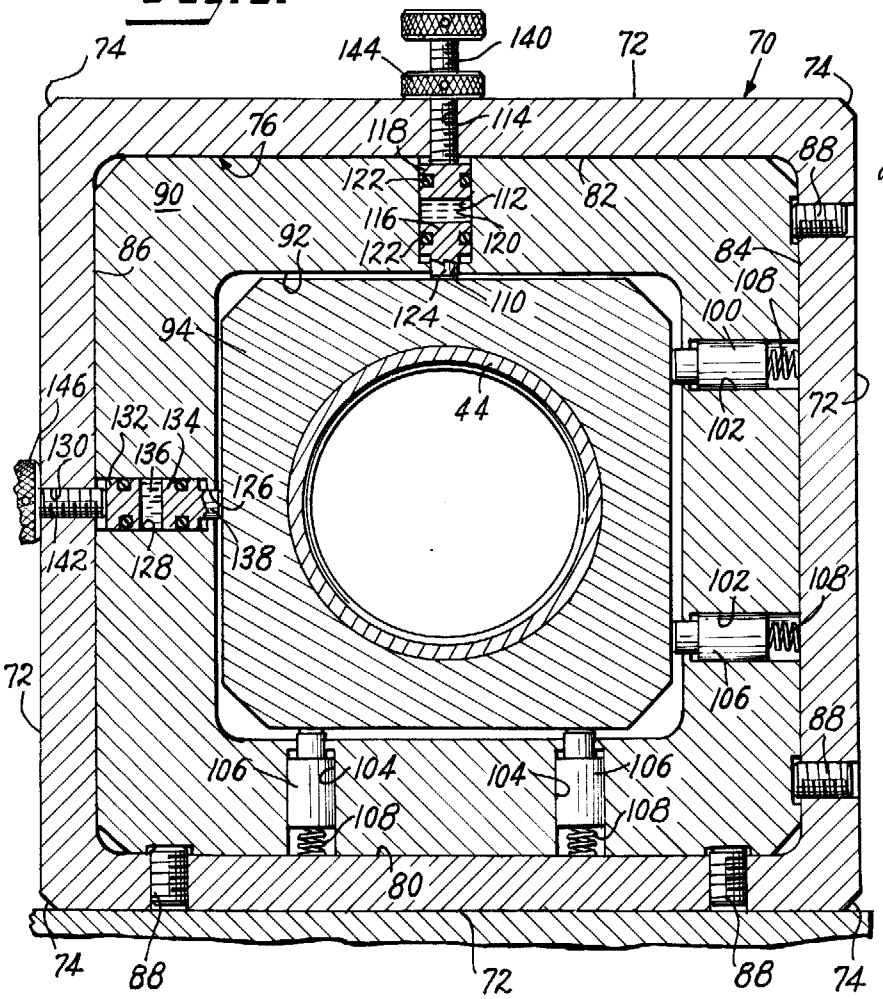
FIG. 6 is a transverse sectional view, on a smaller scale, taken on the line 6—6 of FIG. 4, and showing in greater detail the adjustment mechanism for the die locating blocks.

Turning now to the die holder cartridges 38 and 42, such are especially constructed to provide for precision final adjustment of the dies carried thereby. Referring in particular to FIGS. 4 and 6, the left-hand die holder cartridge 42 mounting one of the redraw dies 44 includes a rectangular tray 70 having precision formed flat surfaces 72 on the periphery thereof, arranged at precise right angles to each other, the corners 74 of the tray 70 being chambered. The tray 70 has an open rectangular chamber 76 formed therein, defined by a flat end wall 78, bottom and top walls 80 and 82, and inner and outer side walls 84 and 86, respectively.

Received in the chamber 76 and secured by set screws 88 is a rectangular location block 90, the block 90 having a generally square opening 92 therein within which is received a similarly shaped mounting block 94 carrying the redraw die 44. A retainer plate 96 is secured to the front face of the tray 70 by screws 98 to retain the location block 90 and the mounting block 94 in the tray chamber 76, and has a circular opening 100 therein for receiving the press ram as it passes through the redraw die 44.

In order to provide for minute, precision final adjustments of the position of the redraw die 44, the location block 90 has a pair of spaced, parallel horizontal stepped bores 102 passing through the inner side wall thereof, and a similar pair of spaced, parallel vertical stepped bores 104 pass through its bottom wall. The stepped bores 102 and 104 all confront the mounting block 96, and house stepped buttons 106 that are biased by coil springs 108 received within sockets in the buttons and seated on the side wall 84 and the bottom wall 80 of the tray chamber 76, respectively. The mounting block 96 is of somewhat smaller dimensions than the square opening 92, whereby it can shift about vertically and horizontally within said opening. The spring-biased stepped buttons 106 function to urge the mounting block 96 toward the top wall and the outer side wall of the opening 92.

Hydraulic adjusters are mounted oppositely the stepped buttons 106, and are operable by adjustment screws to smoothly and finely move the mounting block 96 within the square opening 92 against the resilient force of the springs 108. Referring again to the drawings, the top wall of the location block 90 has a reduced diameter bore 110 positioned centrally thereof, which leads to an enlarged cylindrical chamber 112 that is aligned with a threaded bore 114 in the tray top wall 82. An inner piston 116 and an outer piston 118 are received in the cylindrical chamber 112, the pistons 116 and 118 being separated by a quantity of hydraulic fluid 120, and carrying sealing rings 122 in annular bores on the cylindrical bodies thereof. The inner piston 116 includes a reduced diameter nose portion 124 that projects through the bore 110, and which is engageable with the top face of the mounting block 94.

In a similar fashion, the outer side wall of the location block 90 has a centrally positioned reduced diameter bore 126 and chamber 128 therein, positioned opposite the buttons in the bores 102, and in alignment with a threaded bore 130 in the tray outer side wall 86. Pistons 132 and 134 separated by hydraulic fluid 136 are received in the chamber 128, the piston 134 including a projecting nose portion 138 that is engageable with the outer side wall of the mounting block 94. Vertical and horizontal adjustment screws 140 and 142 are threaded into the bores 114 and 130, respectively, and carry lock nuts 144 and 146 thereon.

It is readily seen that the location of the mounting block 94 with its redraw die 44 can be adjusted with precision in both the vertical and the horizontal directions, by manipulating the adjustment screws 140 and 142. The adjustment screws 140 and 142 respectively are engageable with the pistons 118 and 132, and when threaded inwardly will act through the piston arrangements and the hydraulic fluid quantities 120 and 136 to very smoothly shift the mounting block 94 against the spring-biased buttons 106. The mounting frame 4 of the tool pack 2 is so constructed that the adjustment screws 140 and 142 are at all times fully exposed for ease of manipulation.

It will be seen from the drawings that the two redraw die holder cartridges 42 are identical, the cartridges being placed in their respective mounting slots on the mounting frame 4 so that whether on the right-hand side or the left-hand side of the mounting frame, the adjustment screws 140 and 142 are exposed for manipulation. The ironing die holder cartridges 38 are constructed in a like manner to the cartridges 42, as shown in FIG. 4.

Each of the ironing die holder cartridges 38 includes a rectangular tray 150 having a rectangular chamber 152 therein covered by a retainer plate 154, and within which is carried a location block 156 carrying a mounting block 158 within a square opening 160 therein. The mounting block 158 has a circular socket 162 formed therein for reception of the ironing die 40, the latter being mounted by bearings 164, and being secured in place by a retainer plate 166 fastened by screws 168.

In order to provide for final minute adjustments in the position of the location blocks 156, the cartridges 38 include resilient stepped buttons 170 and adjustment screws 172 like those on the cartridge 42, the adjustment screws 172 each acting through a pair of pistons 174 separated by hydraulic fluid 176, whereby an extremely smooth adjustment capability is ensured. The cartridges 38 are thus mounted like the cartridges 42, and function in the same manner. It is apparent that other types of dies could be mounted in similar cartridges, within the teachings of the invention.

In operation, a power piston or ram of the forming machine or press carries a blank of sheet material through the redraw die 44 and the ironing die 40, whereby a container or the like is formed. Because of the friction and stress created, it is preferable that the blank be lubricated during its passage through the tool pack 2, and for this purpose the separator plate 8 has an annular manifold groove 200 formed therein, in the annular wall of a central opening 202 provided therein for each aligned pair of cartridges 38 and 42. Fitted within the opening 202 is a lubricant distributor sleeve 204, provided with spaced annular slots 206 therethrough. The separator plate 8 has inlet ports 208 therein leading to each of the manifold grooves 200, and the outer ends of said inlet ports 208 have pressure fittings 210 thereon. The distributor sleeves 204 and the lubricant supplied thereto under pressure ensure forced lubrication of the container being formed within the dies.

The ram of the press first passes through the redraw die 44 and then the ironing die 40, and then emerges through an opening 212 in the end plate 12 into the region rearwardly of the tool pack 2. When the press ram completes its forward or forming stroke, it then begins to retract. The invention includes a unique stripper apparatus 250 mounted on the rear face of the end plate 12, designed to ensure removal of the formed container or the like from the ram during the retraction stroke of its operating cycle.

A stripper apparatus 250 is provided for each pair of aligned dies 44 and 40, and each apparatus includes a rectangular base plate 252 secured to the end plate 12 by machine screws 254. The end plate 12 has alignment grooves 256 and 258 cut therein, centered on the discharge opening 212 and intersecting at right angles to each other. The rear face of the base plate 252 carries keys 260 thereon, which are receivable in the alignment grooves 256 and 258 to ensure precise alignment of the stripper apparatus 250 with its associated dies 44 and 40.

The four corners of the base plate 252 are cut at 45° angles, and mounting blocks 262 are secured thereto by screws 264. Each mounting block 264 carries a double-acting hydraulic cylinder 266, including a piston rod 268 that is radially aligned on a longitudinal axis passing through the dies 40 and 44. The forward end of each piston rod 268 has a clevis 270 secured thereto, to which the center leg 272 of a generally T-shaped jaw member 274 is pivoted by a pin 276. The clevis members 270 are each slidingly received within the bore of a guide block 278, secured to the base plate 252 by screws 280.

In addition to the center legs 272 thereof, each jaw member 274 includes an arcuate cross bar portion 282. Taken together, the arcuate portions 282 of the four piston rods 268 do not form a complete circle; rather, a small space exists between the ends of each, and the adjacent cross bar. This space, coupled with the pivoted mounting for the jaw members 274, allows the jaw members to move and adjust slightly as their associated hydraulic cylinders are activated at the conclusion of the forward or forming ram stroke. This adjustment capability can accommodate small misalignments of the forming dies with the stripper apparatus 250.

The stripper apparatus 250 is normally connected to be operated automatically at the end of the power or forming stroke of the press, whereby the jaw members 274 are moved radially inwardly to a point behind the rear end of the formed container. Thereafter, when the power ram withdraws, the jaw members 274 function to strip the container from the ram, whereupon it falls free of the forming apparatus. The circuit in which the hydraulic cylinders 266 are connected is devised to return the jaws 274 to their retracted position, before the next forward or forming stroke commences.

From the foregoing it is believed evident that a unique tool pack has been provided, one wherein the dies are carried by cartridges that can be easily changed on an individual basis, without disturbing other cartridges, and with assurances that the new cartridge will be located with precision. Further, each cartridge has been provided with an adjustment means to permit smooth and precise final alignment changes. Finally, the tool pack also includes a stripper apparatus incorporating jaw members designed to accommodate small misalignments of the forming dies. It is manifest that all of the objects hereinabove set forth for the invention are fulfilled thereby.

Obviously, many modifications and variations of the invention are possible.

I claim:

1. A tool pack for mounting forming dies in a metal drawing machine, said machine including at least one ram, and said tool pack comprising: a mounting frame mountable on said drawing machine in general alignment with said ram, said mounting frame including at least one mounting slot open at the top and along at least a portion of its outer side, and having a bottom wall and an inner side wall arranged at right angles to each other in order to form a seat; a cartridge having means therein for mounting a forming die, said cartridge being rectangular in shape and including a bottom wall, a top wall and side walls arranged at right angles to each other, said cartridge being receivable within said mounting slot with one corner thereof engaged on said seat; and hydraulic clamping means arranged to engage the corner of said rectangular cartridge opposite the corner engaged with said seat, operable to firmly secure said cartridge within said mounting slot.

2. A tool pack as recited in claim 1, wherein said hydraulic clamping means includes: a double-acting hydraulic cylinder carried by said mounting frame, and including a piston rod; clamping arm means operably connected with said piston rod; and a V-block carried on said clamping arm means, said V-block being engageable with said opposite corner of said rectangular cartridge when said hydraulic cylinder is operated to move said piston rod in one direction, and said clamping arm means being arranged to move said V-block free of said cartridge when said hydraulic cylinder is operated to move said piston rod in the opposite direction.

3. A tool pack as recited in claim 2, wherein said mounting frame includes a plurality of mounting slots for receiving a like plurality of cartridges, each of said mounting slots having a hydraulic clamping means associated therewith, and each of said hydraulic clamping means being separably operable so that any selected cartridge can be removed and replaced without disturbing the other cartridges.

4. A tool pack as recited in claim 1, wherein said means within said cartridge for mounting said forming die is adjustable, whereby final minute adjustments can be made in the position of said forming die after said cartridge is received and clamped within its mounting slot on said mounting frame.

5. A tool pack as recited in claim 4, wherein said cartridge comprises: a rectangular tray having a rectangular recess therein; a rectangular location block received and secured within said rectangular recess, and having a rectangular central opening therein; a rectangular mounting block received within said rectangular central opening of said location block, and of smaller dimensions than said opening, said forming die being carried by said mounting block; resilient button means mounted on two adjacent sides of said rectangular central opening, effective to bias said mounting block toward the other two sides of said opening; and screw actuated means on said other two sides of said rectangular central opening, operable to move said mounting block against the force of said resilient button means.

6. A tool pack as recited in claim 5, wherein said screw actuated means comprises: a pair of pistons mounted within a chamber provided in each of said other two sides of said rectangular central opening and carried by said location block, each pair of pistons having a volume of hydraulic fluid trapped therebetween, and the innermost piston of each pair being engageable with said mounting block; and an adjustment screw carried by said rectangular tray for each pair of pistons, said adjustment screws being engageable with the outermost piston of each pair and being operable to move said pistons toward said resilient button means, through said trapped volume of hydraulic fluid.

7. A tool pack as recited in claim 1, further including: stripper apparatus means carried by said mounting frame on the rear end face thereof, and effective to engage behind a container formed on said ram after such has passed through said cartridge carried by said mounting frame.

8. A tool pack as recited in claim 7, wherein said stripper apparatus comprises: a plurality of hydraulic cylinders mounted on said mounting frame and each including a piston rod, said hydraulic cylinders being arranged with said piston rods directed to extend radially toward the axis of movement of said ram; a clevis on the outer end of each of said piston rods; and an arcuate jaw member pivotally connected to each clevis, said jaw members being moved toward and away from the axis of movement of said ram by operation of said hydraulic cylinders.

9. A tool pack as recited in claim 1, further including means carried by said mounting frame for forcefully lubricating material being moved through said forming die by said ram.

10. A tool pack as recited in claim 9, wherein said forceful lubricating means comprises: a lubricant distribution ring arranged to encircle the path followed by said ram as it moves through said tool pack, said ring having a plurality of spaced arcuate openings therein, and said mounting frame including a manifold groove arranged to encircle said distribution ring, and supply bores leading to said manifold groove for carrying lubricant under pressure.

11. In a tool pack, a cartridge for carrying a forming die, said cartridge comprising: a tray having a rectangular recess therein; a rectangular location block received and secured within said rectangular recess, and having a rectangular central opening therein; a rectangular mounting block received within said rectangular central opening of said location block, and of smaller dimensions than said opening, said forming die being carried by said mounting block; resilient button means mounted on two adjacent sides of said rectangular central opening, effective to bias said mounting block toward the other two sides of said opening; and screw actuated means on said other two sides of said rectangular central opening, operable to move said mounting block against the force of said resilient button means.

12. In a tool pack, a cartridge as recited in claim 11, wherein said screw actuated means comprises: a pair of pistons mounted within a chamber provided in each of said other two sides of said rectangular central opening and carried by said location block, each pair of pistons having a volume of hydraulic fluid trapped therebetween, and the innermost piston of each pair being engageable with said mounting block; and an adjustment screw carried by said tray for each pair of pistons, said adjustment screws being engageable with the outermost piston of each pair and being operable to move said pistons toward said resilient button means, through said trapped volume of hydraulic fluid.

* * * * *